US005908146A

United States Patent [19]

Levin

[11] Patent Number: 5,908,146

[45] **Date of Patent: *Jun. 1, 1999**

[54] CAP BRIM SHAPING, TRANSPORT, STORAGE AND DISPLAY DEVICE

[76] Inventor: Gregg Myles Levin, 607 Boylston St., Boston, Mass. 02116

[ * ] Notice: This patent is subject to a terminal disclaimer.

[21] Appl. No.: 08/851,230

[22] Filed: May 5, 1997

Related U.S. Application Data

[63] Continuation-in-part of application No. 08/549,921, Oct. 27, 1995, abandoned, which is a continuation-in-part of application No. 08/345,475, Nov. 28, 1994, Pat. No. 5,533,652.

[51] Int. Cl.[6] ..... D06C 15/00; A42C 1/00; A41F 1/00

[52] U.S. Cl. ..... 223/84; 223/25; 223/24; 24/459

[58] Field of Search ..... 223/84, 24, 25, 223/26, 22, 15, 17, 8, 12; 24/459

[56] References Cited

U.S. PATENT DOCUMENTS

| | | | |
|---|---|---|---|
| 2,779,987 | 2/1957 | Jordan | 24/459 |
| 3,737,081 | 6/1973 | James | 223/84 |
| 4,607,769 | 8/1986 | DeLisle et al. | 223/25 |
| 5,161,719 | 11/1992 | Ottenson et al. | 223/84 |
| 5,163,589 | 11/1992 | Biehl | 223/24 |
| 5,172,837 | 12/1992 | Finney, Jr. et al. | 223/84 |
| 5,533,652 | 7/1996 | Levin | 223/84 |

FOREIGN PATENT DOCUMENTS

| | | | |
|---|---|---|---|
| 1559036 | 3/1969 | France | 24/459 |
| 1350571 | 4/1974 | United Kingdom | 24/459 |

*Primary Examiner*—Bibhu Mohanty
*Attorney, Agent, or Firm*—William Nitkin

[57] ABSTRACT

A device for bowing the brim of a cap and for storing, transporting, washing and/or displaying such cap having a body portion with first and second retention arms extending upwards at each end thereof forming first and second receipt areas at their junctions for receipt therein of the first side and second side of the cap brim, to form such brim into a desired curve. Notches can be disposed inward of each of the receipt areas for receipt of one side of the brim to form alternate brim receipt areas for different desired brim curvatures.

25 Claims, 4 Drawing Sheets

CAP BRIM SHAPING, TRANSPORT, STORAGE AND DISPLAY DEVICE

This application is a continuation-in-part of my previous application under the same title, Ser. No. 08/549,921 filed Oct. 27, 1995, now abandoned which was a continuation-in-part of my previous application under the same title, Ser. No. 08/345,475 filed Nov. 28, 1994, now U.S. Pat. No. 5,533,652.

BACKGROUND OF THE INVENTION

1. Field of the Invention

The device of this invention resides in the area of bowing devices for imparting a desired curve to a bendable structure and more particularly relates to a device into which the brim of a cap is positioned to bend the cap brim into a desired curved shape and which cap is retained in the device until the brim can maintain such curved shape on its own with such device also useful for transporting and storing the cap to maintain the brim in such desired curved shape.

2. Description of the Prior Art

Baseball caps are well known and generally have a fabric dome structure which fits over the head and a brim or visor extending from the front thereof which brim is made of a fabric covering stitched to a cardboard or plastic insert. When a baseball cap is purchased, the brim is a flat, planar member; and many purchasers will initially bend the brim manually to put a curve in it. Some individuals desire to have a more evenly curved brim than can be achieved by means of hand manipulation.

Most brim-bending methods of the prior art are not specifically adapted to put a neat, symmetrical curve in a baseball cap brim. In the prior art a curve is commonly accomplished by placing a somewhat rounded object, such as a baseball glove, under the brim and then curving the brim around the glove. Elastic bands are then placed around the brim and glove to have the brim form a desired even curve and be retained in that position until the brim takes on the desired curve on its own to maintain the brim in such curved shape. Other methods of curving a baseball cap brim are known such as using paper clips to clip the sides of the brim together. Another method requires that the brim be bent before turning the brim inside the cap and partially pulling it through the opening typically found in the rear of a baseball cap to hold the brim in such bent position until the brim retains a curve on its own. Formed wire devices in which caps can be washed and dried are also known. Once a desired curve has been imparted to the brim, such curve is often difficult to maintain over time. For example, if one packs a cap having a brim in a suitcase, during travel pressure from the other contents in the suitcase against the curved brim may cause the brim to flatten out.

SUMMARY OF THE INVENTION

It is an object of this invention to provide a device which will impart a neat-appearing, consistent, symmetrical curve in a desired arc to the brim of a baseball-type cap for improved wearer comfort and overall cap appearance.

It is a further object of this invention to provide a device into which an already curved brim of a cap can be placed, stored and/or transported such as within a suitcase and the like which device will maintain the brim in such desired curved shape.

It is a still further object of this invention to provide a device having a selection of brim curved arcs from which to choose a desired curved shape. The device of this invention also can accommodate brims of various sizes and shapes to be symmetrically shaped in various curved arcs according to the wearer's preference.

It is a yet further object of this invention to provide an attractive display stand for use in the display and/or sale of baseball-type caps. The device of this invention can also be used when washing caps to maintain the curve in the brim.

The device is attachable to and shapes the brim of a cap into a desired conformation for retaining the brim in such desired conformation to set the brim in said conformation or to maintain the brim in said conformation during transport or storage, such device including shaping means, such as a body attachable to the brim of the cap for forming the brim into an arcuate shape, having at least one pair of compression arm elements located in spaced relation to each other, comprising spaced-apart portions of the shaping means. These compression arm elements act as cap mounting elements being located a distance apart from each other which distance is less than at least the width dimension of the brim with each opposite edge of the brim being biased against one of the compression elements to mount the brim in compression therebetween in an arcuate conformation to shape and to set the brim in such arcuate conformation to thereby cause the brim to be formed into the desired bowed shape. The compression elements can include the retention arms and the receipt slots, as described further below. A retention means, such as an elastic band or loop is mountable onto the shaping means for biasing and helping to retain the brim in contact with the shaping means. Catch means are formed on oppositely facing surfaces of the retention arm compression elements, each of the catch means receiving a portion of the stretched retention means for mounting the retention means between the compression arm elements by looping the loops of the retention means over each arm and catching such loop in the catch means for positioning the retention means in contact with upper surfaces of the brim to cause pressure to be exerted against the upper surfaces of the brim by the retention means to force and further compress the edges of the brim against the selected shaping means. A portion of the shaping means can contact and retain the lower surfaces and edges of the brim sides to help hold the brim within the compression elements.

The shaping means can include a plurality of pairs of compression elements with each pair of compression elements having a different distance apart from each element of each pair, such distance between the elements of each pair of compression elements being less than at least one width dimension of the brim. Thus, in a preferred embodiment the shaping means can include a body member with at least one pair of compression elements taking the form of spaced-apart arms, the arms extending from the body member with each arm having surface portions facing each other and against which inwardly facing surface portions of the opposite side edges of the brim are biased to mount the brim in compression therebetween in an arcuate conformation transverse to the brim. The body member is elongated in conformation, and the compression arms are disposed one each at each end of the elongated body member with the body member, in one embodiment, having an upwardly arched central portion. The body member can also have at least one or more notches, such as a pair of spaced-apart notches formed therein between the arms, the spaced-apart notches also acting as a pair of compression elements with the notches being spaced apart a distance which is less than at least one width dimension of the brim, each opposite edge of the brim being positioned into one of the notches of the pair of notches, being adapted for mounting the brim in tension between the notches in an arcuate conformation to shape and to set the brim in said arcuate conformation and to force the brim into a bowed shape. The brim can also be compressed between one notch and one compression arm. A plurality of spaced-apart notches are formed between the arms with each notch being a distance apart from each other notch and from each arm, such distances between a notch and another notch, between a notch and a arm, and between the two arms providing a selection of arches in which to position the brim to form a desired arcuate shape of such brim. At least one of these distances must be less than the width dimension of the brim to be placed therein.

DESCRIPTION OF THE PREFERRED EMBODIMENT(S)

Figure 1:
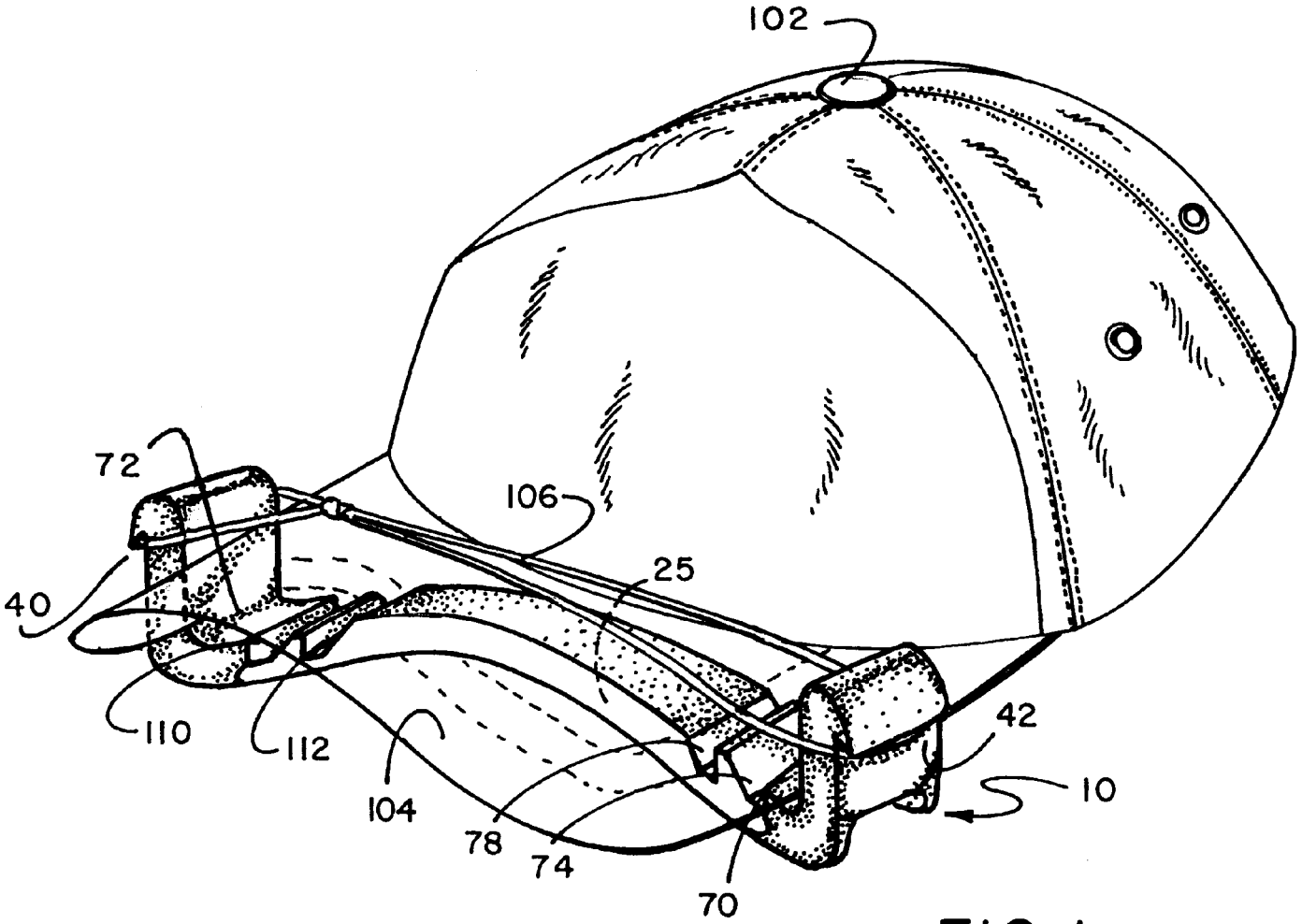
FIG. 1 illustrates a front perspective view of the cap brim shaping and storage device of this invention in use with a cap brim secured therein.
Figure 2:
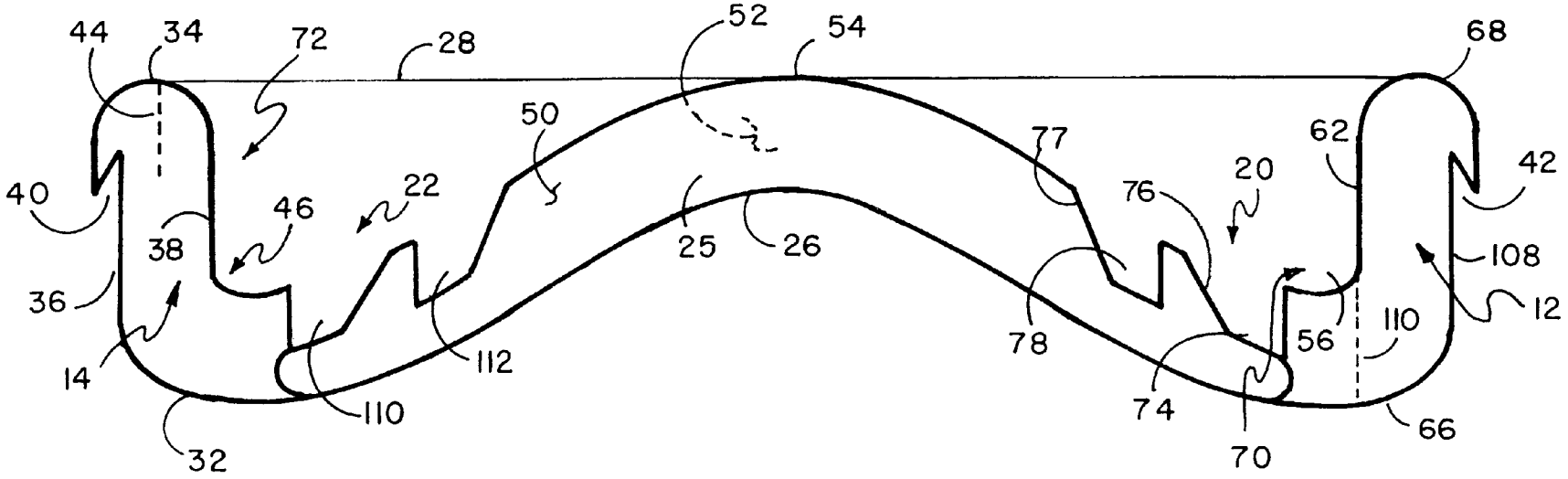
FIG. 2 illustrates a front view of the device of this invention.

FIG. 1 illustrates a front perspective view of the cap brim shaping means and storage device 10 of this invention with a typical baseball cap 102 positioned in the device with its brim 104 held in place in the device by a retention means such as elastic band 106 which can be a rubber band or equivalent to exert downward pressure on the top of the brim to force the sides of the brim against compression arm elements such as first and second retention arms 12 and 14, seen in FIG. 2, which retention arms in one embodiment are closer together than the sides of the brim when the brim is in a flattened state, causing the brim to bow in a curve.

FIG. 2 illustrates a front view of the device of this invention enlarged and without a cap positioned therein. Shown are the possible alternate selection of brim retention sites available to the user when using the device of this invention. As seen in FIG. 2, the shaping means of this device in a preferred embodiment consist of a laterally disposed, unitary one-piece body having a central portion with a top side, a bottom side, a front side, a rear side and a center arched portion 25 having first and second ends 66 and 32 and a crown 54 centrally disposed thereon having a height with center arched portion 25 having an upward arch 26 on its bottom side. The body of the device slopes downward, respectively, on each side of crown 54 to form, respectively, first and second shoulders 20 and 22. The device then curves sharply upwards at the ends of the central portion, forming first and second ends 66 and 32 which, in turn, form cap mounting elements being first and second retention arms 12 and 14, respectively, having, respectively, first top 68 and second top 34 such that said first and second tops reach approximately to the height of crown 54. The body of the device loosely resembles a stretched out letter "W". The distance between first and second retention arms 12 and 14 is generally less than the width of the brim to be curved for many caps sizes. Second outer side 36 of the second retention arm 14 and first outer side 108 of the first retention arm 12 have protruding therefrom, respectively, retention means being second catch 40 and first catch 42.

When the device is in use, as seen in FIG. 1, a retention means such as a rubber band 106, elastic member, or equivalent retention means is positioned, as described above, extending over the brim and exerting downward pressure on the top of the brim. The retention means are tensioned and stretched to engage first catch 42 and second catch 40. When the device is in use, the first side of brim 104 is snugly positioned in second valley 46 formed by the junction of second inner side 38 of second retention arm 14 which arm extends upward approximately perpendicular to a line 28 drawn along the lateral axis of device 10, forming second receipt area 72 where the body of the device extends up to form second retention arm 14. The second side of the brim rests and is caught within second receipt area 72 and cannot move laterally outward as it is stopped and caught by second retention arm 14 and by the downward pressure exerted by elastic band 106 on the top of the brim as seen in FIG. 1. The first and second sides of brim 104 can fit in several brim retention sites as described below. When the second side of the brim is positioned within second receipt area 72, the device, in its simplest form, only requires one first receipt area for it to function, such as first receipt area 70 formed by the junction of first shoulder 20 and first inner side 62 where first retention arm 12 extends upwards from first shoulder 20. The first side of the brim can be retained in position within first receipt area 70 by positioning it adjacent to first inner side 62 of first retention arm 12 to catch and retain the first side of the cap brim. When the device is used with most adult-sized baseball caps, the first side of the brim would rest near the center of first receipt area 70 and be retained in position by an elastic band stretched over and contacting the top of the brim and extending from, and connecting, second catch 40 to first catch 42 being protrusions formed, respectively, on the outer sides, respectively, of second retention arm 14 and first retention arm 12. If one desired a more bowed curvature of the brim or if a smaller sized cap brim were desired to be curved, one would insert the first side of brim 104 into spaced-apart notches, such as either first slot 74 or second slot 78 which are both disposed in shoulder 20 further inward from first retention arm 12. To help the brim fit into first slot 74 or second slot 78, the upwardly extending inner sides of each slot are disposed toward the central portion of the device at an acute angle to a line drawn vertical thereto, such as first slot side 76 of first slot 74 and second slot side 77 of second slot 78. Second slot 78 is disposed further inward from first slot 74 and is also of a width to receive the first side of the brim. Second slot 78 disposes the first side of the brim therein at an even greater brim curvature than if the first side of the brim were disposed in first slot 74. On the other side of arched central portion 25 defined within second shoulder 22 can be third and fourth slots 112 and 110, respectively, which also have their inner sides oppositely angled to those of first and second slots 74 and 78 for receipt of the side of the second side of the brim therein. When one wishes a sharper curved brim or if one has a smaller cap brim, the user has the option of extending the brim, for example, from first slot 74 to fourth slot 110 or from first slot 74 to third slot 112 for a very sharply curved brim. For curving a very small brim, one could engage the first and second sides of the brim, respectively, into second slot 78 and third slot 112.

Figure 3:
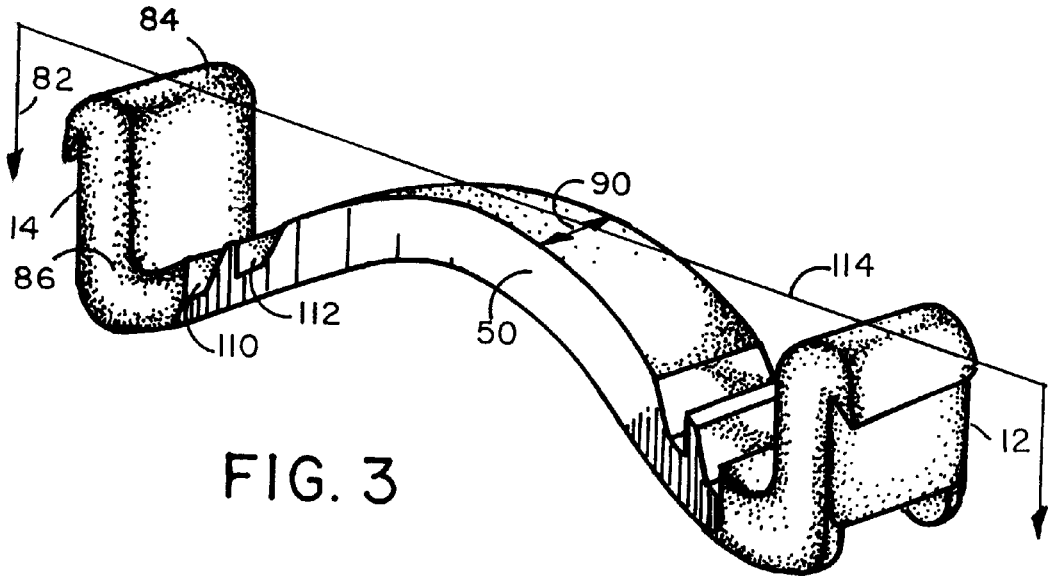
FIG. 3 illustrates a perspective view of the device of this invention.
Figure 4:
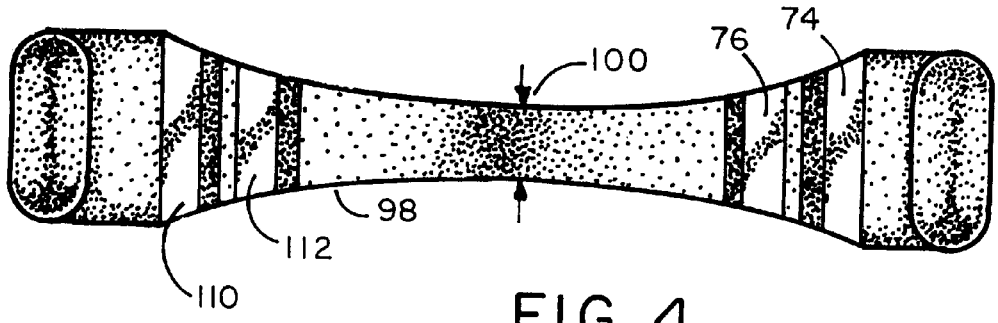
FIG. 4 illustrates a top view of the device of this invention.

As seen in FIGS. 2 and 3, the arched central portion of the body of the device can have a flattened front side 50 and a flattened rear side 52. As seen in FIGS. 3 and 4, the device can also be tapered inwardly on sides 50 and 52 to form narrow portion 90 being the thickness of the device near crown 54. As illustrated in FIG. 3, first and second retention arms 12 and 14 are elongated laterally and disposed in a perpendicular plane 82 to axis line 114 drawn along the length of the body of the device. In contrast to the thickness of narrow portion 90, the thickness of first and second retention arms 12 and 14 can be more than twice the thickness of the device at crown 54. Other lengths, widths and thicknesses of the device and its retention arms would still allow the device of this invention to function successfully. As also seen in FIG. 3, the retention arms can have rounded tops 84 as well as rounded sides 86 for easier storage and handling of the device and for a more pleasing appearance. By having the first and second retention arms have an elongated thickness along its height, the retention arms are better able to hold and retain the first and second sides of the brim within the device. The flattened front side 50 and flattened rear side 52 can be utilized as surfaces for the receipt of imprinting or placement of indicia such as advertising or brand or team names thereon. As seen in FIG. 4, flattened front and rear sides 50 and 52 can have a front inward curvature 98 and rear inward curvature 100 which curvatures do not affect one's ability to read any imprinting thereon. In a preferred embodiment the height of central portion 25 and crown 54 thereof can rise to a point similar in height to the height of the tops of first and second retention arms 12 and 14.

Figure 5:
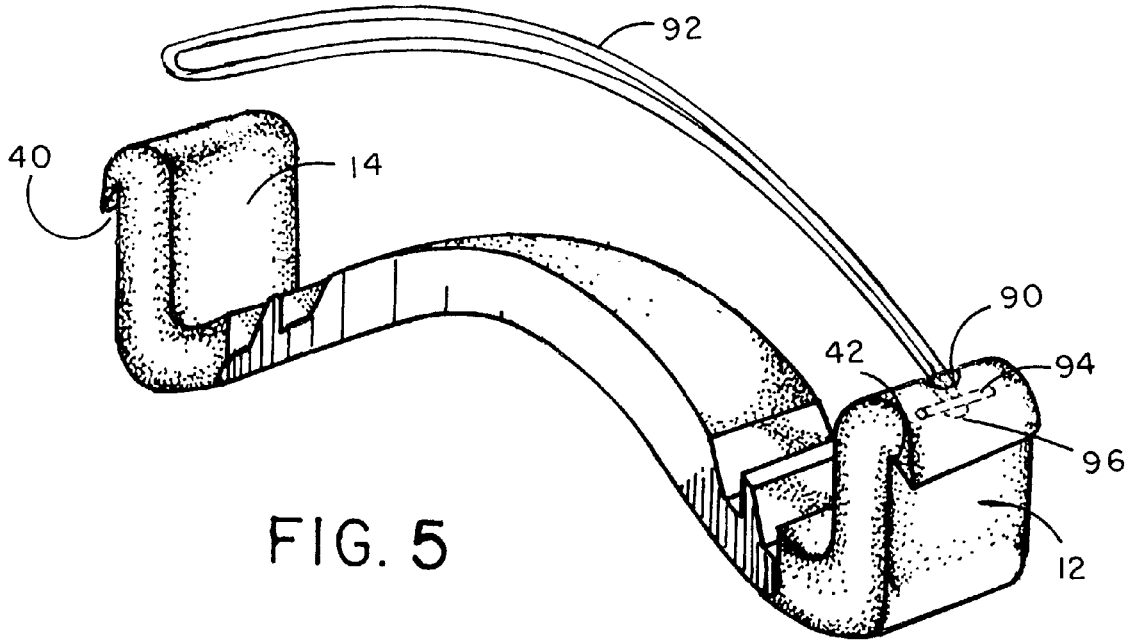
FIG. 5 illustrates a perspective view of the device of this invention showing an alternate embodiment of the elastic band.

FIG. 5 illustrates an alternate embodiment of the device of this invention wherein an elastic band 92 is attached at one end 96 to a metal barb 94 which, when twisted parallel to elastic band 92, can be passed through aperture 90 in the top of a retention arm such as first retention arm 12. Retention arm 12 can be hollow in its interior so as to provide space to receive elastic band 92 and attached metal barb 94 therethrough and to provide space for metal barb 94 to move to a position perpendicular to elastic band 92 so as to cause its side portions to catch inside first retention arm 12 and prevent its passing out of aperture 90. In this manner, one end of elastic band 92 is fixedly attached to the upper portion of one of the retention arms. In use, the brim of a cap is positioned within the desired receipt areas and/or slot areas and elastic band 92 is passed thereover held at its attached end to the top of one of the retention arms and then passed around and caught in the retention means, such as second catch 40. The fixed attachment of one end of elastic band 92 to a retention arm prevents its inadvertent loss and makes the device somewhat easier to use as only one end of the elastic band has to be manually attached to the catch on the opposite retention arm.

The device not only can be used to form a desired curvature in the brim of a cap, but also can be used as a storage device when the cap is not in use by repositioning the cap therein in order to maintain the desired curvature such as when the cap is packed in a suitcase so that the brim will not be inadvertently flattened by surrounding articles in the suitcase.

The device of this invention can also be used as a display stand such as for cap collectors or in the sale of baseball caps. The brim of a cap can be placed in a curved position, as described above, with the front of the device providing an imprint receipt area along flattened front side 50 for any printed indicia or information such as store identification, advertising or pricing information.

Apart from the retention means, the device of this invention in a preferred embodiment can be made of a unitary, single piece of plastic, metal, wood or any equivalent sturdy material or can be made of a plurality of component parts forming the unitary whole.

Although the present invention has been described with reference to particular embodiments, it will be apparent to those skilled in the art that variations and modifications can be substituted therefor without departing from the principles and spirit of the invention.

I claim:

1. A device for bowing the visor brim of a cap, said brim having a first side, a second side, a top and a width with the distance between said first side and said second side being the width of said brim, comprising:

a unitary, one-piece body having a central portion having a top, a length, a center portion, a front side, a rear side and first and second ends;

a first retention arm forming part of said body extending upwardly from said first end of said central portion of said body, said first retention arm having an outer side;

a second retention arm forming part of said body extending upwardly from said second end of said central portion of said body, said second retention arm having an outer side;

a first receipt area defined at the junction of said first retention arm and said central portion of said body;

a second receipt area defined at the junction of said second retention arm and said central portion of said body, the distance between said first and second receipt areas being less than the width of said brim;

said device in its use mode having said first and second sides of said brim positioned, respectively, in said first and second receipt areas of said device, forcing said brim into a bowed state;

a first catch means disposed on said outer side of said first retention arm and a second catch means defined on said outer side of said second retention arm; and retention means connecting said first catch means and said second catch means, said retention means extending over said top of said brim and exerting downward pressure on said top of said brim, forcing said first and second sides of said brim outward to be compressed, respectively, against said first and second retention arms to further force said brim into a bowed state.

2. The device of claim 1 further including:

catch means disposed on said outer side of said first retention arm;

retention means having a first end and a second end; and means for retaining said first end of said retention means disposed on said first retention arm, said first end of said retention means being retained by said means for retaining a retention means, said retention means extending over said top of said brim and said second end of said retention means being connected to said second catch means, said retention means exerting downward pressure on said top of said brim and forcing said first and second sides of said brim outward to be compressed, respectively, against said first and second retention arms to further force said brim into a bowed state.

3. The device of claim 1 further including:

first and second shoulders defined, respectively, between said top and said first end of said body and between said top and said second end of said body, said first and second shoulders each having a top side;

a first slot defined in said top side of said first shoulder inward of said first receipt area, said first slot to alternatively receive said first side of said brim;

a second slot defined in said top side of said first shoulder further inward of said first slot, said second slot to alternatively receive said first side of said brim;

a third slot defined in said top side of said second shoulder inward of said second receipt area, said third slot to alternatively receive said second side of said brim; and a fourth slot defined in said top side of said second shoulder between said third slot and said second receipt area, said fourth slot to alternatively receive said second side of said brim.

4. The device of claim 3 wherein said first and second catch means are protrusions formed, respectively, on said outer sides of said first and second retention arms.

5. The device of claim 4 wherein said front side and said rear side of said center portion of said body are flattened to form an indicia receipt area.

6. The device of claim 5 wherein said first slot, second slot, third slot and fourth slot each have an inner side and an outer side, said inner sides being disposed at an angle toward said center portion of said body.

7. A device for bowing the visor brim of a cap, said brim having a first side, a second side, a top and a width with the distance between said first side and said second side being the width of said brim, comprising:

a unitary central body having a top, a length, a center portion, a front side, a rear side and first and second ends, wherein said center portion includes first and second opposed shoulders, respectfully inward of said opposed ends, each of said shoulders having a top side;

a first retention arm forming part of said central body extending upwardly from said first end of said body to form a junction, said first retention arm having an outer side;

a second retention arm forming part of said central body extending upwardly from said second end of said body to form a junction, said second retention arm having an outer side;

a first receipt area defined at the junction of said first retention arm and said body above said first shoulder;

a second receipt area defined at the junction of said second retention arm and said body above said second shoulder, the distance between said first and second receipt areas being less than the width of said brim;

said device in its use mode having said first and second sides of said brim positioned, respectively, in said first and second receipt areas of said device, forcing said brim into a bowed state;

retention means, having opposed ends, extending over said top of said brim for exerting downward pressure on said top of said brim and forcing said first and second sides of said brim outward to be compressed, respectively, against said first and second retention arms to further force said brim into a bowed state; and first and second means for fixing said opposed ends of said retention means to said retention arms.

8. A device for bowing the visor brim of a cap, said brim having a first side, a second side, a top and a width with the distance between said first side and said second side being the width of said brim, comprising:

a unitary central body having a top, a length, a center portion, a front side, a rear side and first and second ends, where said center portion includes first and second opposed shoulders, respectively inward of said opposed ends, each of said shoulders having a top side;

a first retention arm forming a part of said central body extending upwardly from said first end of said body to form a junction, said first retention arm having an outer side;

a second retention arm forming part of said central body extending upwardly from said second end of said body to form a junction, said second retention arm having an outer side;

a first receipt area defined at the junction of said first retention arm and said body above said first shoulder;

a second receipt area defined at the junction of said second retention arm and said body above said second shoulder, the distance between said first and second receipt area being less than the width of said brim;

said device in its use mode having said first and second sides of said brim positioned, respectively, in said first and second receipt areas of said device, forcing said brim into a bowed state;

catch means disposed on said outer side of said first retention arm;

retention means having a first end and a second end; and means for retaining said first end of said retention means disposed on said first retention arm, said first end of said retention means being retained by said means for retaining, said retention means extending over said top of said brim and second end of said retention means being connected to said second retention arm, said retention means exerting downward pressure on said top of said brim and forcing said first and second sides of said brim outward to be compressed, respectively, against said first and second retention arms to further force said brim into a bowed state.

9. The device of claim 7 further including:

a first slot defined in said top side of said first shoulder inward of said first receipt area, said first slot to alternatively receive said first side of said brim;

a second slot defined in said top side of said first shoulder further inward of said first slot, said second slot to alternatively receive said first side of said brim;

a third slot defined in said top side of said second shoulder inward of said second receipt area, said third slot to alternatively receive said second side of said brim; and a fourth slot defined in said top side of said second shoulder between said third slot and said second receipt area, said fourth slot to alternatively receive said second side of said brim.

10. The device of claim 9 wherein said first and second catch means are protrusions formed, respectively, on said outer sides of said first and second retention arms.

11. The device of claim 10 wherein said front side and said rear side of said center portion of said body are flattened to form an indicia receipt area.

12. The device of claim 11 wherein said first slot, second slot, third slot and fourth slot each have an inner side and an outer side, said inner sides being disposed at an angle toward said center portion of said body.

13. A device attachable to the visor brim of a cap to shape said brim into a desired conformation, to retain said brim in the desired conformation, to set the brim in said conformation and maintain said brim in said conformation during transport or storage, as desired, said brim having opposite edges and an upper surface, said distance between said opposite edges defining the width of said brim, comprising:

shaping means attachable to said brim of said cap for forming said brim into an arcuate shape;

at least one pair of compression elements, each compression element of each pair having an inward and an outward facing surface, said compression elements of a pair located in spaced-apart relation to each other and comprising spaced portions of said shaping means, said compression elements of a pair being located a distance apart from each other less than said width of said brim, each opposite edge of said brim being biased against one pair of said compression elements to mount said brim in compression therebetween in an arcuate conformation to shape and to set the brim in said arcuate conformation, thereby to cause said brim to be formed into a bowed shape;

retention means mountable to said shaping means for retaining said brim in contact with said shaping means; and a plurality of pairs of compression elements with each pair of compression elements having a different distance apart from its associated other element of the pair, said distance between the elements of each pair of compression elements being less than the width of said brim.

14. The device of claim 13 further including:

first and second catch means formed on said oppositely facing outer surfaces of said compression elements, each of said catch means receiving a portion of said retention means for mounting said retention means between said compression elements for positioning said retention means in contact with said upper surface of said brim to cause pressure to be exerted against said upper surface of said brim by said retention means.

15. The device of claim 14 wherein said retention means is formed of an elastic material.

16. The device of claim 14 wherein said retention means comprises a loop of elastic material.

17. The device of claim 16 further including:

means for mounting said retention means to said shaping means for positioning said retention means in contact with said upper surface of said brim to cause pressure to be exerted against said upper surface of said brim by said retention means.

18. The device of claim 17 wherein said retention means is formed of an elastic material.

19. The device of claim 17 wherein said retention means comprises a loop of elastic material.

20. The device of claim 13 wherein said shaping means comprise:

a body member having first and second ends; and wherein said compression elements take the form of spaced-apart first and second arms, said first and second arms extending, respectively, from said first and second ends of said body member and each arm having an inwardly-facing surface portion and against which surface portions opposite edges of said brim are biased to mount said brim in compression therebetween in an arcuate conformation transverse to said brim.

21. The device of claim 20 further including:

retention means mountable to said first and second arms for retaining said brim in a shaped position relative to said shaping means; and catch means formed on said oppositely facing surfaces of each of said arms, each of said catch means receiving a portion of said retention means for mounting said retention means between said arms for positioning said retention means in contact with said upper surface of said brim to cause pressure to be exerted against said upper surface of said brim by said retention means.

22. The device of claim 21 wherein said body member is elongated in conformation and said first and second arms are disposed, respectively, at said first and second ends of said elongated body member, said body member having an upwardly arched center portion.

23. The device of claim 20 wherein said body member is elongated in conformation and said arms are disposed, respectively, at said first and second ends of said elongated body member, said body member having at least one notch formed therein between said first and second arms, said notch comprising a compression element with said notch being spaced apart a distance from another compression element which distance is less than said width of said brim, each opposite edge of said brim being positioned into said notch and one of said compression elements to mount said brim in tension between said notch and said compression element in an arcuate conformation to shape and to set the brim in said arcuate conformation, thereby causing said brim to be forced into a bowed shape.

24. The device of claim 23 further including at least one pair of spaced-apart notches defined in said elongated body member between said first and second arms, each pair of spaced-apart notches forming compression elements.

25. The device of claim 23 further including a plurality of pairs of spaced-apart notches defined in said elongated body member between said first and second arms with the distance between each notch of each pair of spaced-apart notches being different, said distance between the notches of each pair of notches being less than the width of said brim.

* * * * *